US005257880A

United States Patent [19]

Janopaul, Jr.

[11] Patent Number: 5,257,880

[45] Date of Patent: * Nov. 2, 1993

[54] RETAINING WALL CONSTRUCTION AND BLOCKS THEREFOR

[75] Inventor: Peter Janopaul, Jr., Modesto, Calif.

[73] Assignee: Graystone Block Co., Modesto, Calif.

[ * ] Notice: The portion of the term of this patent subsequent to Sep. 3, 2009 has been disclaimed.

[21] Appl. No.: 700,755

[22] Filed: May 15, 1991

Related U.S. Application Data

[63] Continuation-in-part of Ser. No. 557,956, Jul. 26, 1990, Pat. No. 5,044,834.

[51] Int. Cl.[5] ..... E02D 29/02

[52] U.S. Cl. ..... 405/284; 405/286; 52/562; 52/585; 52/606

[58] Field of Search ..... 411/920; 52/585, 586, 52/562, 169.4, 170, 606, 608, 609, 611, 607; 405/284, 285, 286

[56] References Cited

U.S. PATENT DOCUMENTS

| | | | |
|---|---|---|---|
| 262,635 | 8/1882 | Adams | 411/920 X |
| 274,481 | 3/1883 | Frost | 411/920 X |
| 312,460 | 2/1885 | Haight | 411/920 X |
| 319,607 | 7/1885 | Nelson | 411/920 X |
| 324,126 | 8/1885 | Le Gay | 411/920 X |
| 389,660 | 9/1888 | Mandel et al. | 411/920 X |
| 1,412,582 | 4/1922 | Vaile | 411/920 X |
| 1,671,895 | 5/1928 | Fritz | 411/920 X |
| 4,470,728 | 9/1984 | Broadbent | 405/284 |
| 4,825,619 | 5/1989 | Forsberg | 52/607 X |
| 4,920,712 | 5/1990 | Dean, Jr. | 52/605 X |
| 5,044,834 | 9/1991 | Janopaul, Jr. | 52/562 X |
| 5,066,169 | 11/1991 | Gavin et al. | 405/284 |
| 5,114,270 | 5/1992 | Riddle | 405/284 X |
| 5,161,918 | 11/1992 | Hodel | 405/286 |

FOREIGN PATENT DOCUMENTS

| | | | |
|---|---|---|---|
| 2348043 | 8/1974 | Fed. Rep. of Germany | 405/286 |

*Primary Examiner*—Carl D. Friedman
*Assistant Examiner*—Robert Canfield
*Attorney, Agent, or Firm*—Julian Caplan

[57] ABSTRACT

In general, a block and retaining wall formed by a number of such blocks are interconnected between courses by a plurality of Z-shaped anchor elements having an upper and lower body part of substantially rectangular cross-section as viewed in plan. The upper body part is offset from the lower body part. The offset of one course of blocks relative to the course beneath will be a predetermined fixed amount determined by the offset of the body parts of the interlocking Z-shaped anchor elements. A tie-back arrangement includes means for attaching a sheet of geo-synthetic material to the embedded end of a block so as to leave the open cells within and those formed between the blocks unobstructed from above and available for filling with pea gravel or other drainage fill material.

8 Claims, 12 Drawing Sheets

FIG 1
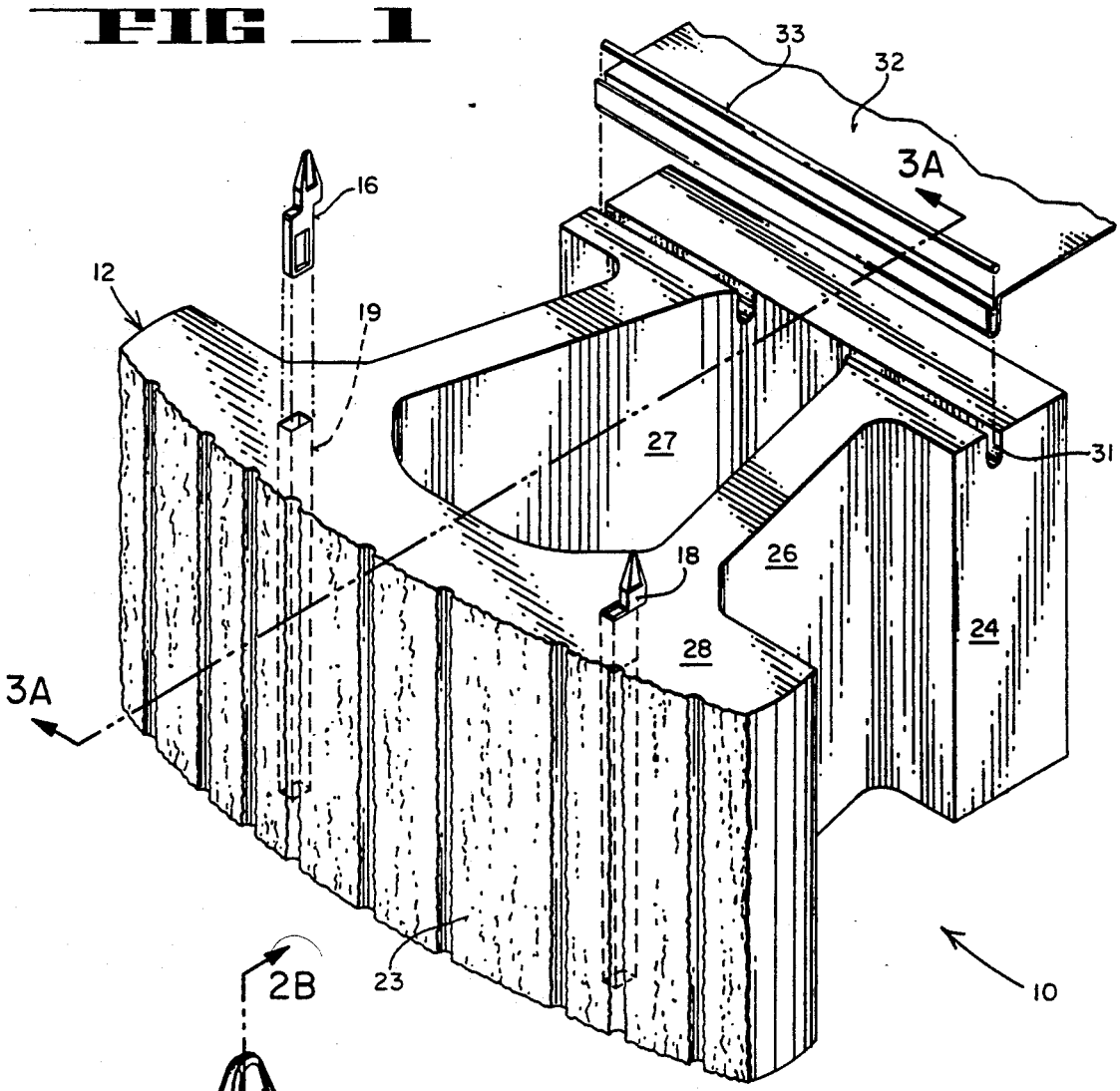
FIG 2B
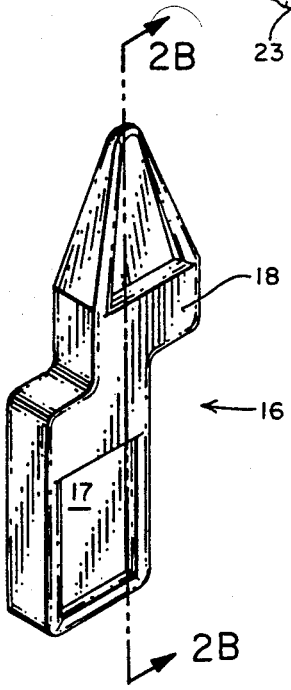
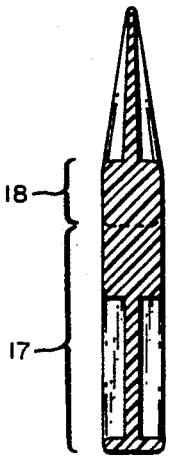
FIG 2A

RETAINING WALL CONSTRUCTION AND BLOCKS THEREFOR

This is a continuation-in-part application of my copending application entitled RETAINING WALL CONSTRUCTION AND BLOCKS THEREFOR, filed Jul. 26, 1990 as Ser. No. 07/557,956 now U.S. Pat. No. 5,044,834.

FIELD OF INVENTION

This invention pertains to wall blocks and a block wall construction and to such blocks particularly suitable in making retaining walls for securing terraces and embankments.

BACKGROUND OF THE INVENTION

Conventional retaining walls are used to secure earth embankments against sliding and slumping. Retaining walls are made of various types of concrete, solid masonry, wood ties, bricks and blocks of stone and concrete. The blocks are placed in rows and superimposed on top of each other to form a wall. An example of blocks used in the construction of retaining walls is shown by Forsberg in U.S. Pat. No. 4,914,876. The foregoing patent discloses blocks stacked in a plurality of courses or layers interlocked by means of elongate pins extending up through a block and into a shallow elongate pocket disposed in the under surface of the next course of blocks.

In addition, a tie-back arrangement has been shown whereby a geogrid sheet is retained by the interconnecting pins. Thus the presence of the geogrid sheet buried in the retained soil behind the wall serves to stabilize the wall and soil.

However, use of the pins as the holding means serves to cause the geogrid sheet to block off the otherwise open cells of the wall. These open cells normally are loaded with pea gravel or other drainage material.

The geogrid sheet, when held as above described, can cause the smaller sizes of drainage material to "bridge" openings of the sheet and prevent complete filling of the open cells. This lack of complete filling can allow the retained earth behind the wall to invade the unfilled cells and prevent proper drainage or cause settlement of the retained earth behind the wall.

In addition, use of the interlocking pin arrangement, as shown in the above patent, leaves the degree of backward and upward slope in the face of the wall in the hands and eye of the worker whereby such slope will generally be inconsistent or erratic along the length thereof.

Thus, use of such tieback material attached at the front of the block (as in the above patent) dictates that pea gravel or other drainage material must be filled into the open cells of the block or formed between blocks) before attachment of the tieback material.

SUMMARY OF THE INVENTION AND OBJECTS

In general, this invention comprises an improved construction block and retaining wall made therefrom. The courses of blocks are interlocked by an improved interlocking device, hereafter a "Z" anchor, which serves to offset each adjacent upper layer of blocks by a predetermined degree so as to define the degree of the predetermined backward and upward slope in the face of the wall.

In addition, an improved means for securing geo-synthetic material to protrude from the back side of the wall into soil behind the wall can be characterized by an elongate slot formed crosswise into the top surface of the block, as well as by two improved means using staples.

By disposing the block sides and the positioning Z anchors at the quarter points of the block the inner side walls of superposed blocks will be readily aligned between courses to form smooth walled cells adapted to receive drainage material therein.

The improved means for anchoring the loading edge margin of a sheet of geogrid material to the trailing body portion of the block provides a more positive connection therebetween.

In addition, each block has been formed with an elongate groove in the top of the rear body portion of the block as explained above. An additional improvement herein is a beveled surface on the back side of said groove to permit the leading edge margin of the sheet of geogrid material to lie flush thereon.

In general it is an object of the present invention to provide an improved wall block and retaining wall construction.

Another object of the invention is to provide an improved retaining wall construction made from wall blocks and having improved means for providing a tie-back function to various portions of the wall.

Yet another object of the invention is to provide a retaining wall construction from such blocks having improved interlocking means between successive courses of blocks whereby a retaining wall so made will have a predetermined upward slope.

Yet a further object of the invention is to provide an improved interlocking element for use in conjunction with wall blocks.

Yet an additional object of the invention is to provide an improved means for attachment of a tie-back sheet to the rear body portion of a block.

Another object of the invention is to provide rigid or semi-rigid staples having a pair of spaced apart elements disposed to enter associated openings in said block after capturing of a tie-back sheet so as to positively engage the sheet.

The foregoing and other objects of the invention will become more readily evident from the following detailed description of a preferred embodiment when considered in conjunction with the drawings.

This anchoring of the geosynthetic material at the rear of the retaining wall block eliminates the problem of placing drainage material into the now open unobstructed cavities of the block wall, i.e. ¾" rock can now be used as a substitute for pea gravel which will do a better job of drainage more economically, and allow the filling to be done at any time as opposed to tying it to the placement of the tieback material.

BRIEF DESCRIPTION OF THE DRAWINGS

FIG. 1 shows a diagrammatic exploded perspective view of a wall block for use in constructing a retaining wall according to the invention;

FIG. 2A shows a diagrammatic perspective view of an interlocking elements as used in conjunction with the wall block of FIG. 1;

FIG. 2B shows a side elevation view in section taken along the line 2B—2B of FIG. 2A;

DETAILED DESCRIPTION OF PREFERRED EMBODIMENTS

Figure 6A:
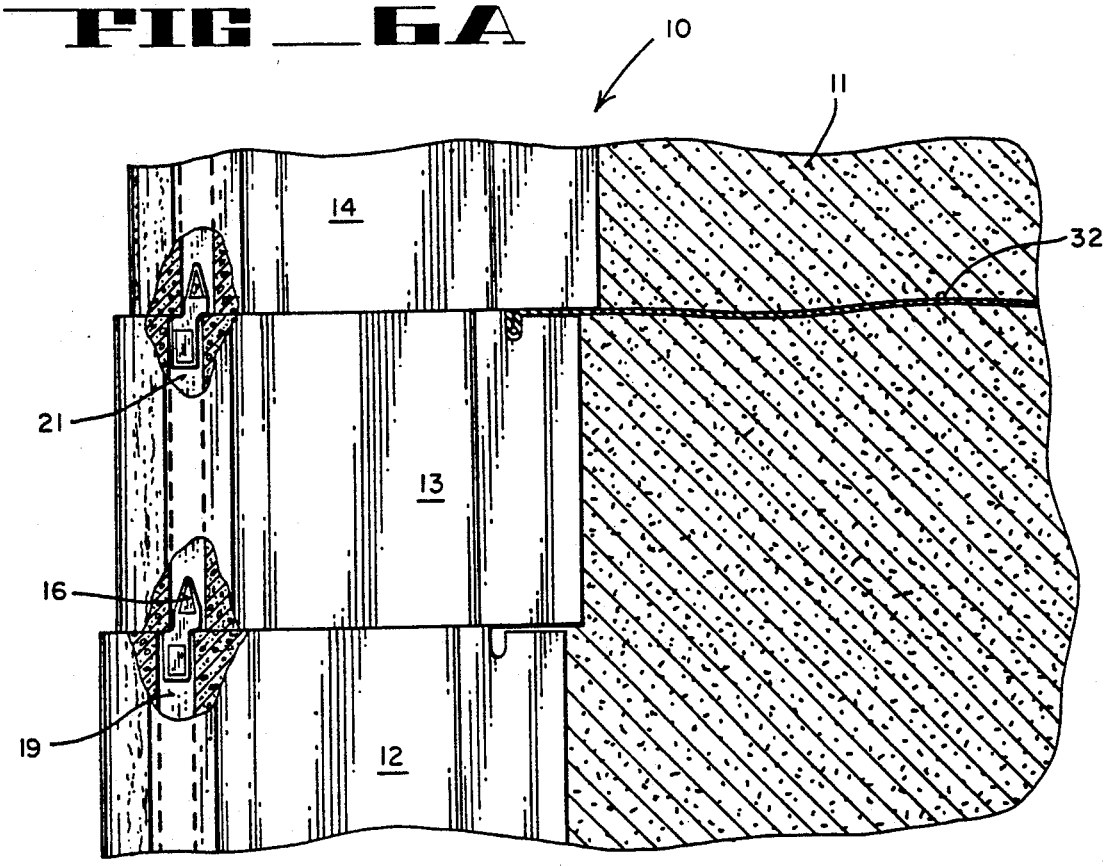
FIG. 6A shows an enlarged side elevation section view of three courses in the retaining wall shown in FIG. 4 with portions broken away for clarity.
Figure 6B:
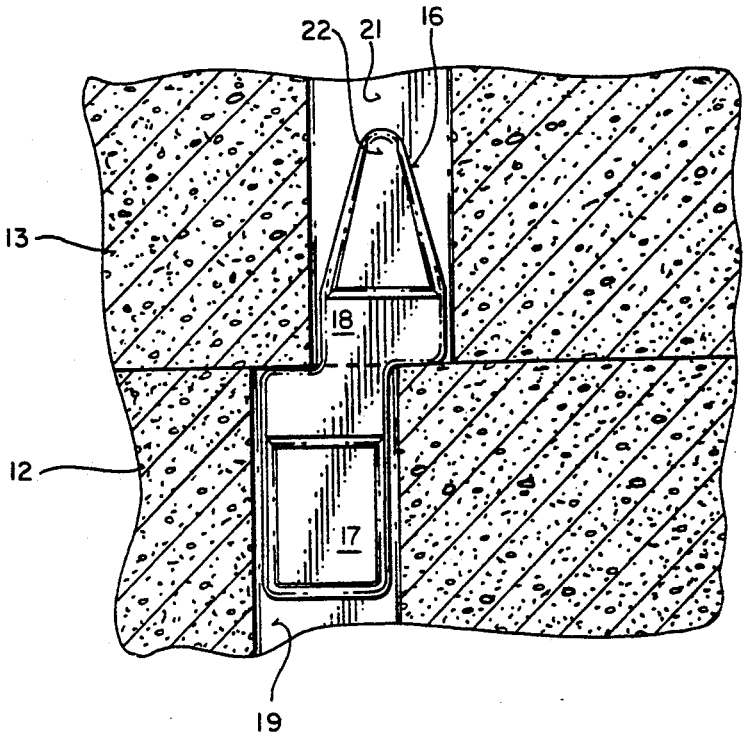
FIG. 6B shows an enlarged detail of an interlocking element disposed between vertically adjacent blocks of a retaining wall defining the offset which is provided to the upper course of blocks.
Figure 6C:
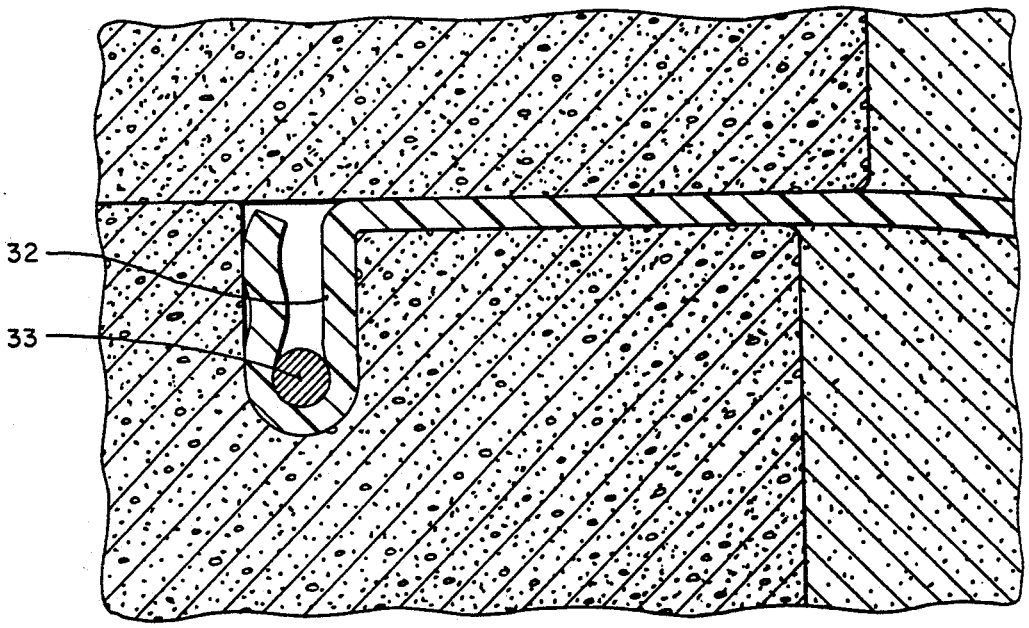
FIG. 6C shows an enlarged detail of a means for retaining a geogrid sheet to a portion of the blocks.

As shown in FIGS. 6A through 6C an improved retaining wall construction 10 serves to hold back a volume of earth 11. Retaining wall 10 has been formed by a number of courses or layers of concrete blocks 12, 13, 14. While blocks 12 through 14 are identical they have been so numbered so as to refer to three successive courses of blocks of the retaining wall 10. Thus, as noted above, retaining wall 10 includes a number of courses, each course containing a number of concrete blocks 12, 13 and 14. Wall construction 10 has a predetermined, upward slope established by means now to be described for interlocking the blocks 12, 13, 14 between courses and serving to define the degree of said slope. The interlocking means includes a plurality of Z anchors 16. Anchors 16 each include non-circular first and second elongate body parts 17, 18. Body part 17 includes, along the length thereof, a cross-section as viewed in plan having angles disposed at the periphery thereof so as to cooperate with and fit within a similar non-circular opening on the underside of a block 12, 13, 14 to inhibit rotation or mis-orientation of anchor 16 within its associated openings receiving the first and second body parts 17, 18.

More particularly, body part 17 includes, in plan, a generally rectangular periphery as does body part 18. However, this cross-section of body part 17 extends substantially the full length of part 17 whereas the rectangular plan configuration of body part 18 extends only along a limited length thereof. In addition, the first and second body parts 17, 18 are relatively offset with respect to each other by a predetermined degree whereby mounting of a block 13 onto elements 16 of a block 12 causes block 13 to be slightly offset whereby successive adjacent courses of blocks will become offset in a manner defining the degree of the upward slope of the wall.

Finally, anchor 16 fits within the bottom and upper elongate openings 19, 21 joined to extend through an associated block 12, 13. Openings 19, 21 are formed with a generally rectangular cross-section so as to prevent blocks between side walls 26, 27 serve to contain a supply of pea gravel or other drainage material disposed therein. Accordingly, the tie-back means includes a sheet 32 of flexible tie-back material which is preferably a strong polymer. Sheet 32 is retained in slot 31 by a semi-rigid wedging element, preferably, such as a pencil rod 33 of metal or plastic laid parallel to the plane of sheet 32 and driven to move in the plane of slot 31. In this way as shown best in FIG. 6C the pencil rod will press the opposite sides of sheet 32 to wedge same into slot 31.

The upper surface 24A of body 24 beyond slot 31 has been slightly reduced in height in order to accommodate the presence of sheet 32. This is primarily noted in FIG. 6C as well.

As noted above, openings, such as 19 and 21, can be the opposite ends of a pair of continuous passageways extending from the top surface 28 to the bottom surface 29 of block 12.

Figure 3A:
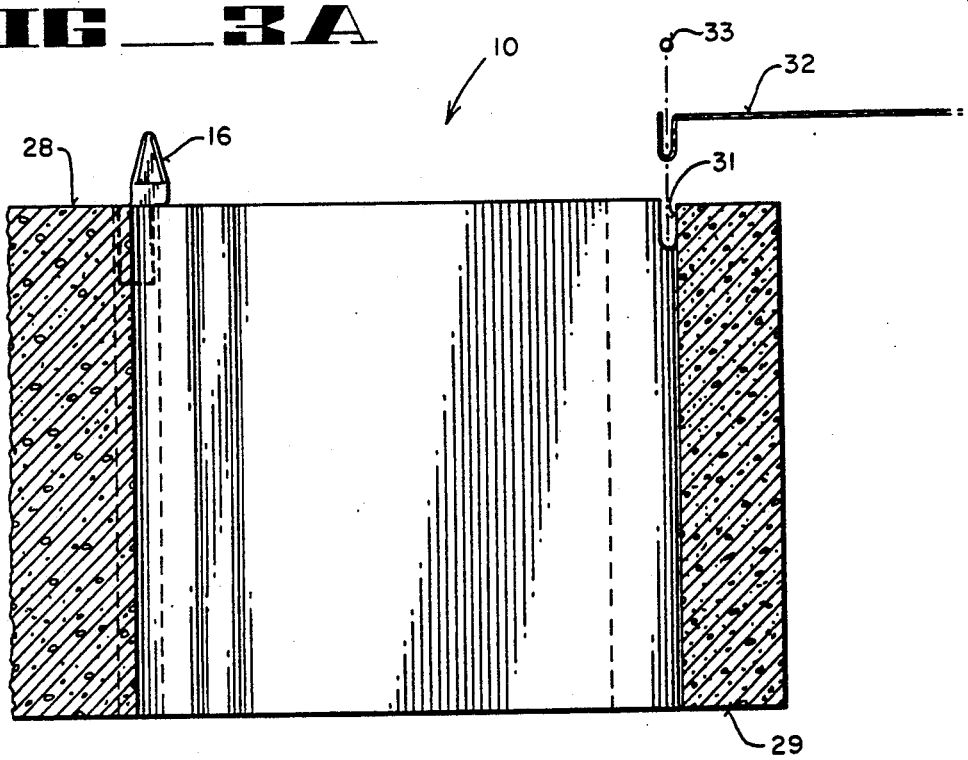
FIG. 3A shows an elevation section view taken along the line 3A—3A of FIG. 1.
Figure 3B:
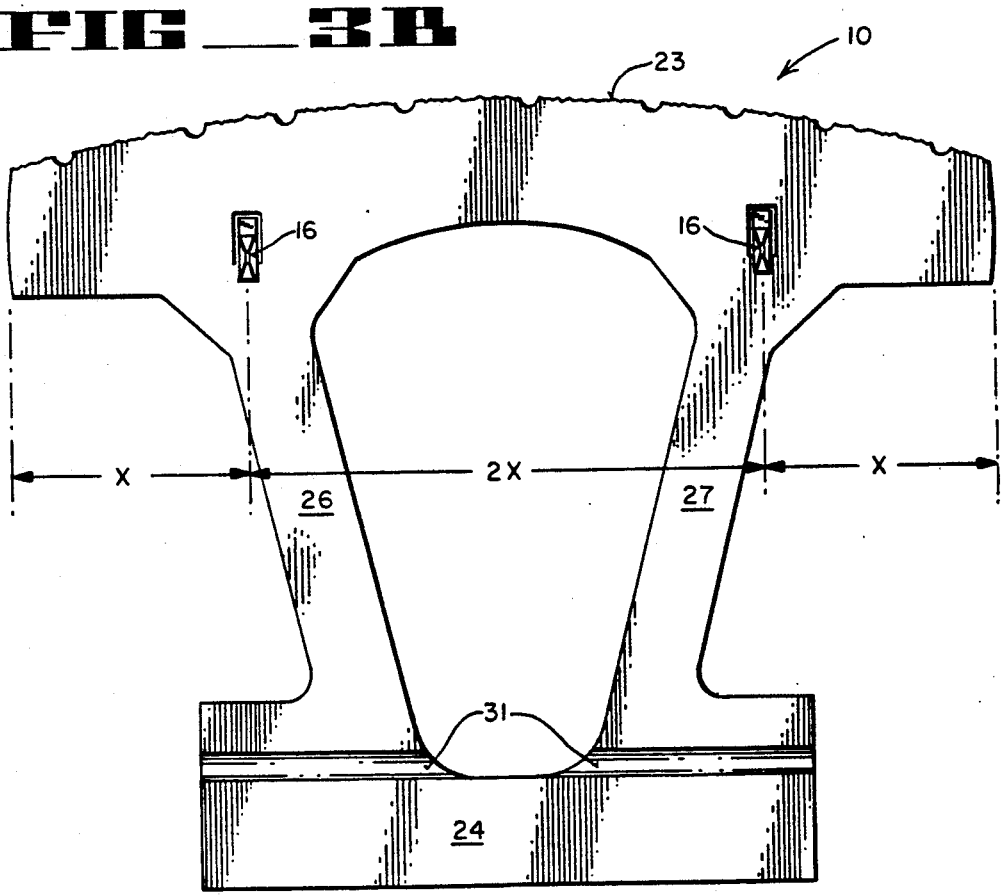
FIG. 3B shows a diagrammatic plan view of a block as shown in FIG. 1.
Figure 7:
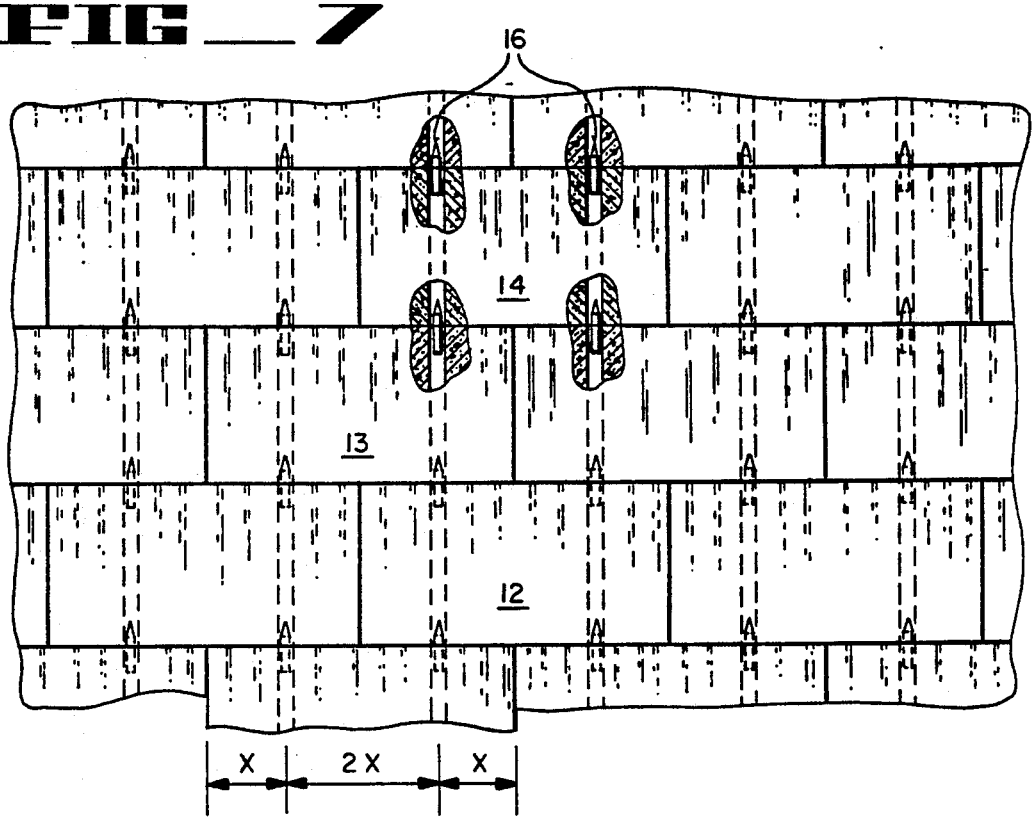
FIG. 7 shows a front elevation view of a retaining wall construction with portions broken away showing the presence of interlocking elements.
Figure 8:
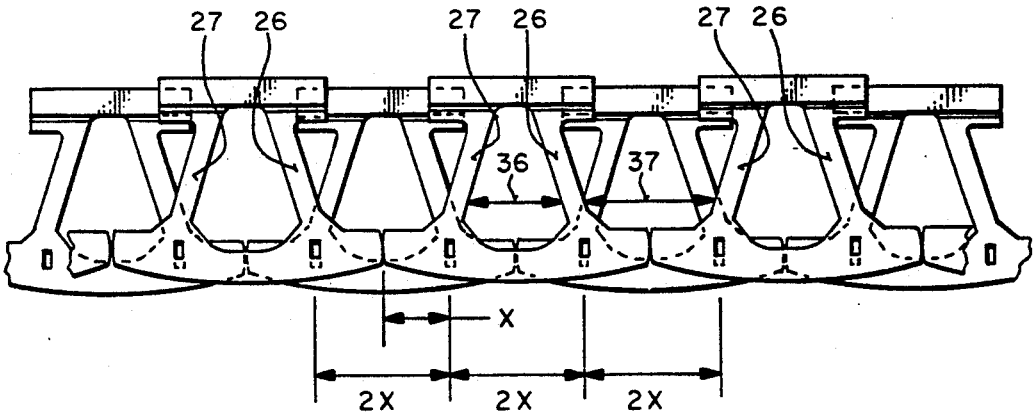
FIG. 8 shows a diagrammatic plan view of the disposition of a plurality of courses of retaining wall blocks for purposes of explanation.

In addition, openings 19, 21 are disposed, as shown in FIGS. 3B, 7 and 8 so that they lie at the so-called quarter points. As thus arranged, the blocks of successive courses can be disposed in running bond.

Figure 4:
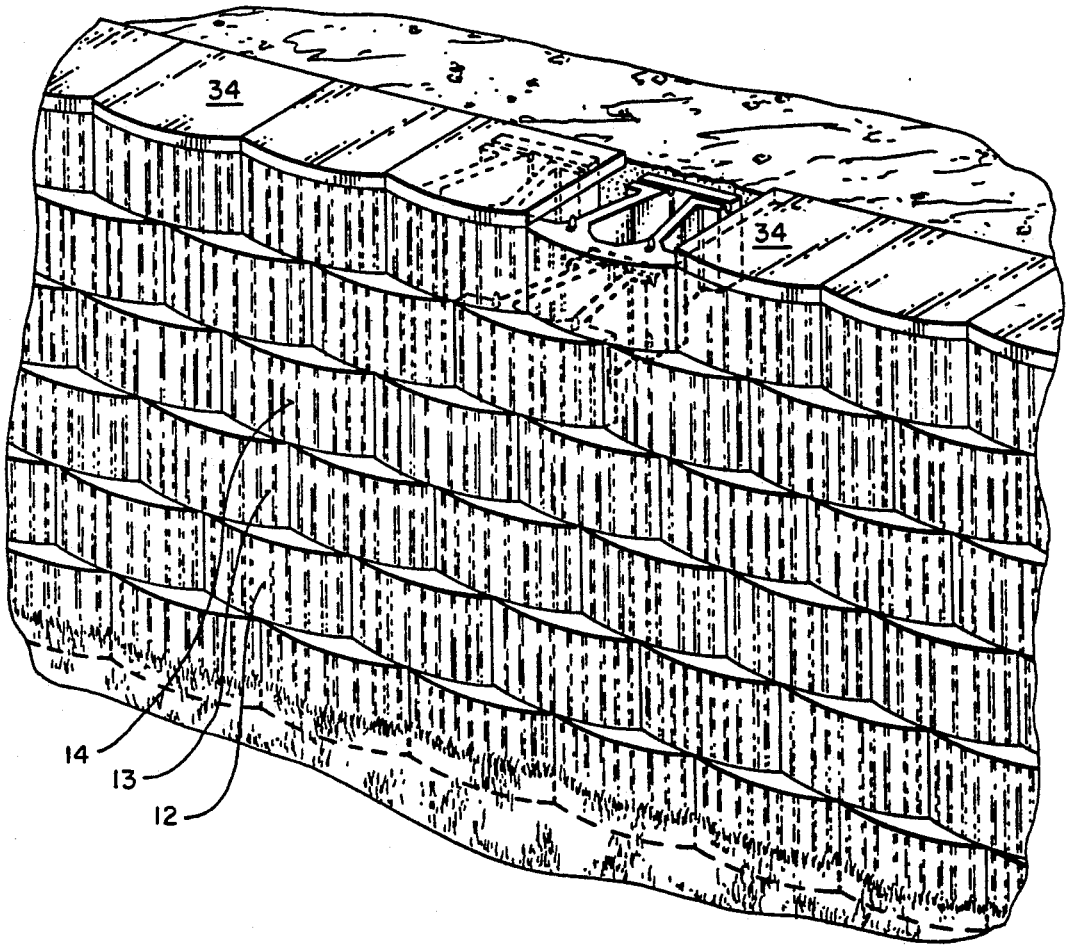
FIG. 4 shows a diagrammatic perspective view of a retaining wall construction made from the blocks shown in FIG. 1.
Figure 5:
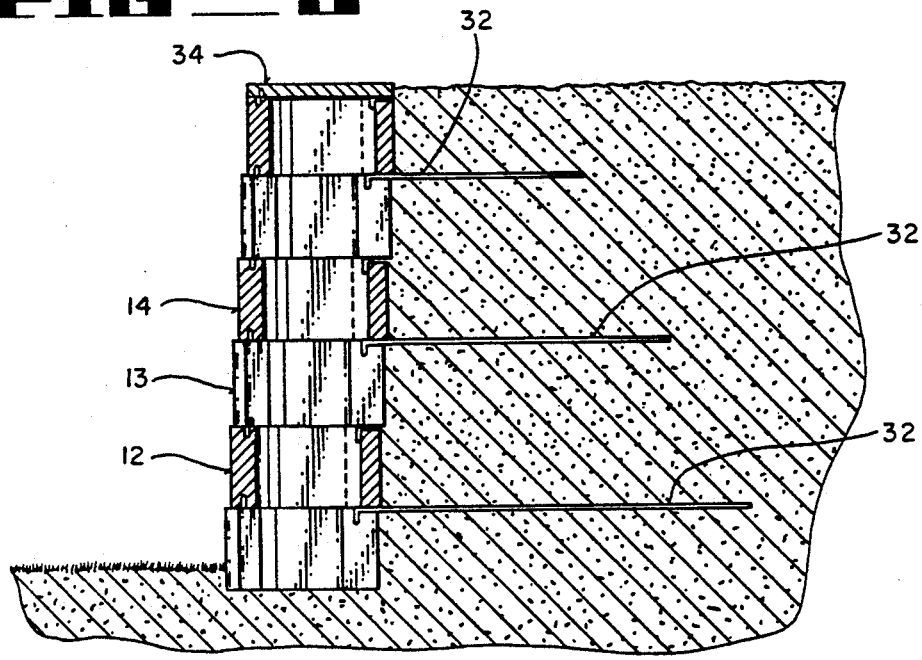
FIG. 5 shows an elevation section view of the retaining wall construction as shown in FIG. 4.

Finally, as shown in FIGS. 4 and 5, the top of the retaining wall is formed by applying a relatively thin cap member 34 to provide a finished appearance to the top surface of the wall.

Based on the foregoing it will be readily evident that there has been provided an improved concrete block and retaining wall formed by a number of such blocks arranged to be interconnected between courses by a plurality of Z-shaped 12, 13, 14 from rotating about the axis of a portion 17, 18 of anchor element 16.

As noted above, by means of the use of a rectangular cross-section for body parts 17, 18, it will be readily evident that the cross-section as viewed in plan has angle means disposed at the periphery thereof and shaped and dimensioned to conform to the inner side walls of the openings 19, 21. Body part 18 carries thereon a progressively upwardly reduced upper end portion 22 serving to guide body portion 18 into opening 21 exposed underneath one of the blocks, such as 13.

A block 12, as shown in FIG. 1, has been formed with an arcuate outer face 23, which should be primarily decorative in appearance. The opposite end of block 12 carries a generally rectangularly shaped body 24 of concrete supported by side walls 26, 27 extending between the backside of front face 23, at the quarter points thereof, and body 24.

As shown in FIG. 1, however, side walls 26, 27 connect at positions located somewhat inwardly from the ends of front face 23, preferably at the quarter points thereof, so as to provide an improved structure. The top and bottom surfaces 28, 29 of block 12 are generally flat. The foregoing block structure provides an improved construction in that extraneous non-functioning material has been eliminated, which also makes the blocks weigh less per square foot of wall surface, thereby resulting in reduced wall costs.

Further, tie-back means have been coupled to the blocks 12, 13, 14 and include an elongate slot 31 formed in the top of rectangular body 24. The open cells defined anchors having an upper and lower body part of substantially rectangular cross-section as viewed in plan. The upper body part is offset from the lower body part so as to provide a slight offset of the adjacent upper course of blocks from a lower course of blocks. The amount of this offset will be a predetermined fixed amount in every instance determined by the offset of the body parts of the interlocking Z-anchors.

Accordingly, a retaining wall having a uniform slope will be provided.

In addition, a tie-back arrangement includes a flexible sheet of strong polymer material folded into a slot and retained therein by driving a semi-rigid wedging element, such as a pencil rod 33, between the folded edge margin of the sheet. Accommodation is made for the presence of such a sheet between vertically adjacent blocks so as to inhibit any tipping of the blocks with respect to each other due to the presence of the sheet of material therebetween.

Finally, by securing the edge margin to a trailing portion of the blocks, cells 36, 37 will remain open from above whereby drainage fill material can be deposited therein from above at any stage of construction.

In addition to the foregoing embodiment, additional embodiments have been provided as now to be described with respect to FIGS. 9 through 23.

Figure 9:
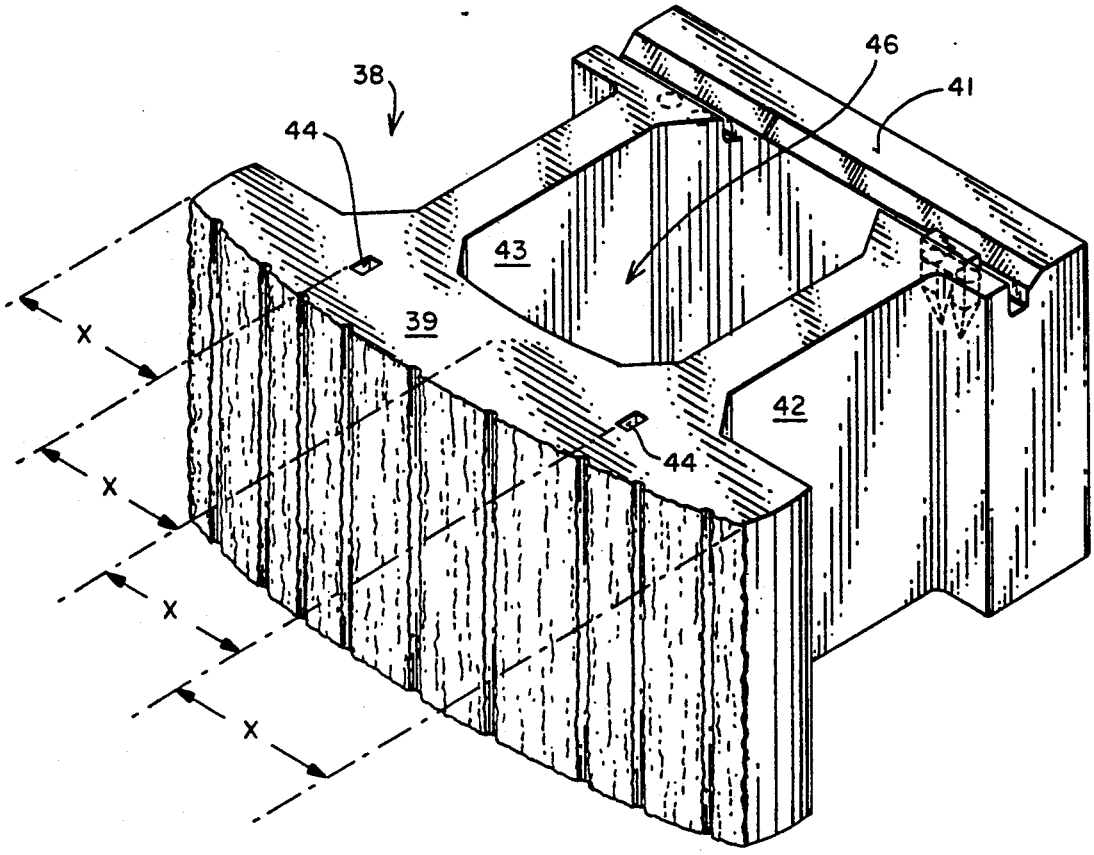
FIG. 9 shows a perspective viewed from above another embodiment of the invention.
Figure 10:
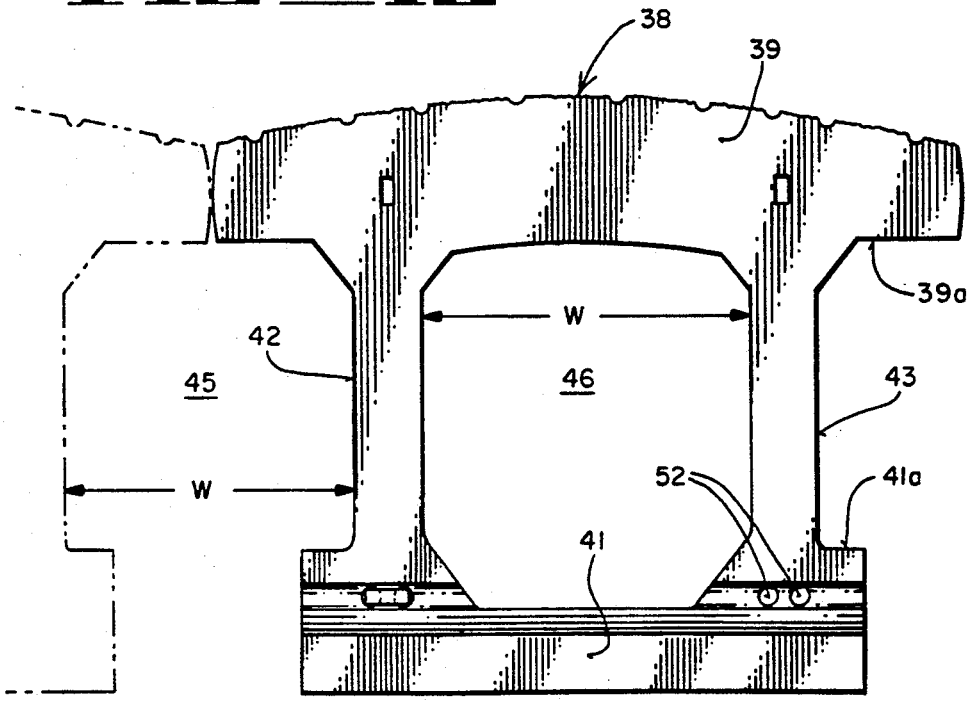
FIG. 10 shows a plan view of FIG. 9.

As shown in FIGS. 9 and 10, a wall block 38 for use in making a retaining wall according to another embodiment, includes leading and trailing bodies 39, 41 disposed in spaced relation with respect to each other.

A pair of parallel side walls 42, 43 extend between the quarter points of leading body 39 and the front face of trailing body 41. In this manner an unobstructed cell 46 is formed between walls 42 and 43 and the front and the back of the block. Reference to the structure of FIGS. 9 and 10, thus the blocks are positioned in layers in a wall. The side wall 43 of a first of two adjacent blocks in an upper layer overlies side wall 42 of the block of the lower layer. Side wall 42 of a second of the two adjacent blocks in the upper layer overlies side wall 43 of the block of the lower layer. Since half cells 45 are half the width of cell 46, and side walls 42 and 43 are of equal width, cells are free from obstruction and substantially continuously uninterrupted.

Interlocking means of the kind described above with respect to the Z-anchors are carried by the leading body 39 in the rectangular openings shown at the quarter points 44. The upper ends of the Z-anchors as before, serve to protrude therefrom for interengaging the leading body of a second block 38B (FIG. 11) disposed thereon so as to positively locate the two blocks with respect to one another in a manner disposing the side walls 42, 43 of the superimposed cells 46 in a substantially continuous uninterrupted plane leaving a multi-cell opening 47 free of any obstruction therein to enable drainage fill material, such as pea gravel or the like to be readily poured into the multi-cell opening 47 from above.

It has been observed that a more positive connection between the tie-back sheet 32 and the block 38 is desirable to avoid improper attachment of the sheet and block by a few unskilled workers who have been found to erroneously use the Z-anchors for connecting the tie-back sheet between courses of block. Thus, as disclosed below a more positive interconnection between a tie-back sheet 48 and blocks 38 has been provided as now to be described.

Figure 12:
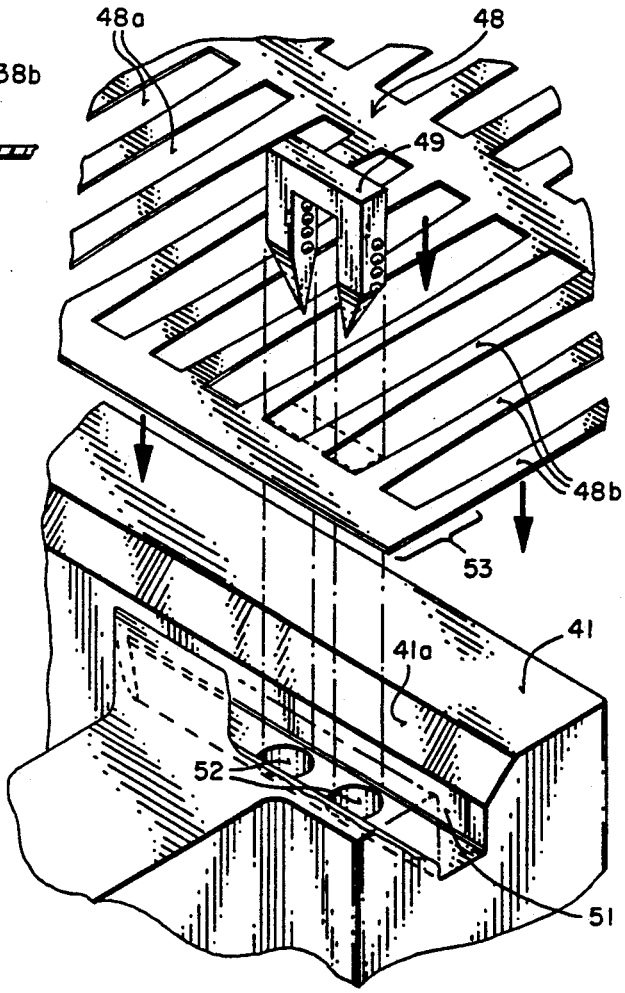
FIG. 12 shows an exploded perspective view with portions broken away for clarity of a staple in position to attach a corner of tie-back material to a block.
Figure 13:
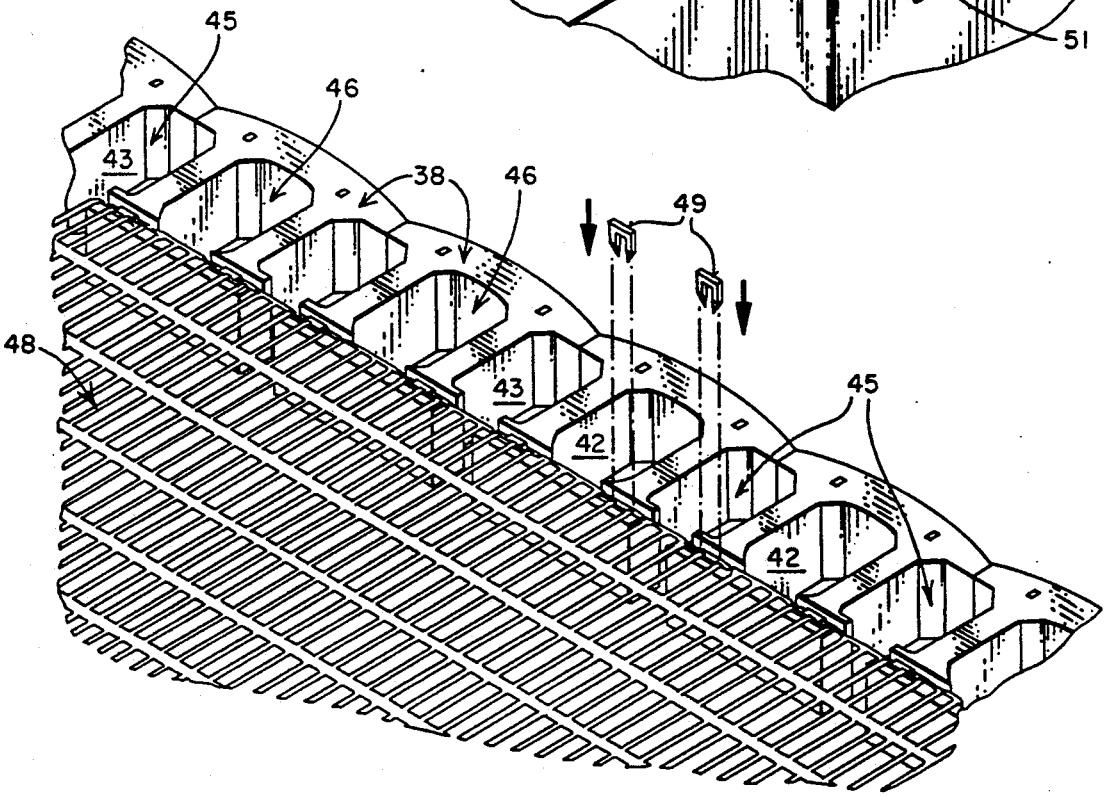
FIG. 13 shows a perspective view from above of a bottom course of blocks anchoring a sheet of material.

As shown in FIG. 12, according to one embodiment, a staple 49 for use in anchoring a sheet of tie-back material 48 in which the sheet of tie-back material includes many elongate openings 48*a* therein and disposed in parallel relation in a manner defining narrow strands 48*b* of material therebetween. Staples 49 serve to capture a single strand 48*b* as it has been folded into a slot 51 formed in the trailing body 41. In the embodiment of shown in FIG. 12 a pair of openings 52 extended downwardly from the base of groove 51.

Figure 11:
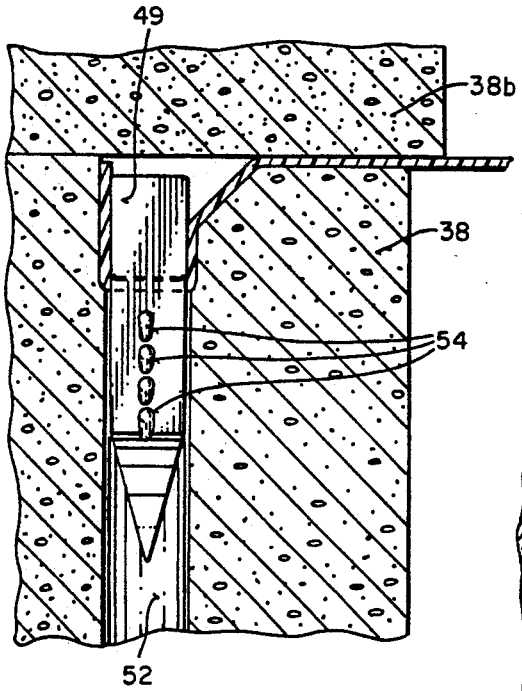
FIG. 11 shows an enlarged side elevation section view of an anchoring staple disposed in a pair of openings in the block of FIG. 9.
Figure 14:
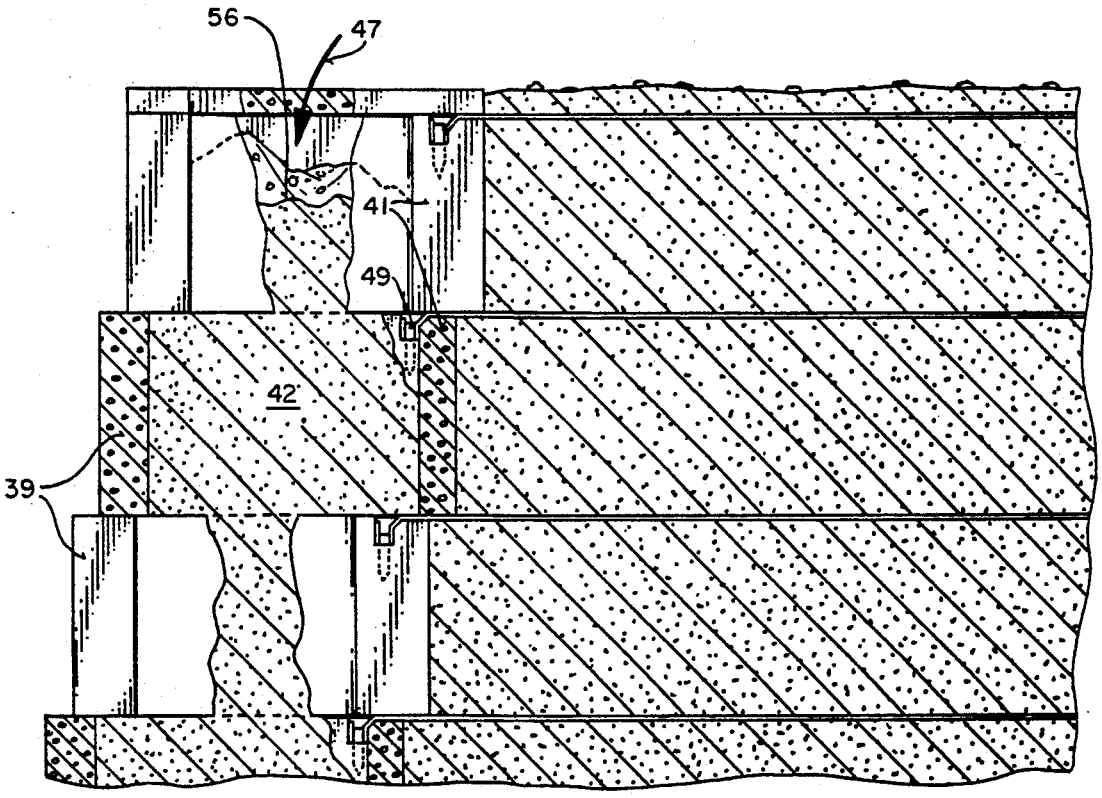
FIG. 14 shows an enlarged side elevation section view of a portion of a four course wall loaded with drainage material in the cells thereof.
Figure 15:
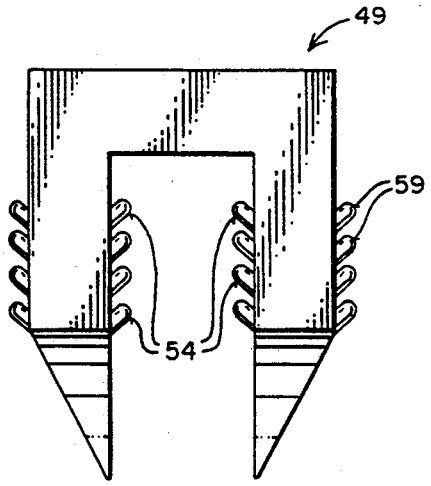
FIGS. 15 and 16, respectively, show front and side elevation views of the staple shown in FIGS. 11 and 12.
Figure 16:
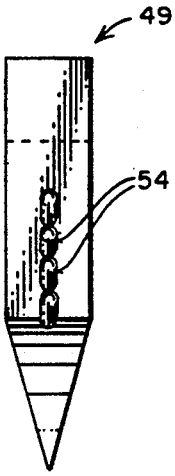

In addition, the leading upper edge of body portion 41 has been beveled as at 41*a* whereby the leading edge margin 53 can be readily folded into slot 51 as shown in FIG. 11. After having folded the leading edge margin into slot 51, a staple 49 is driven downwardly into openings 52 so as to straddle one of strands 48*b*. Staple 49 is held securely in openings 52 by means of the laterally protruding nibs 54 which engage the side walls of their associated openings. Further, as shown in FIG. 15, the nibs 54 preferably are angled upwardly so as to permit the staple to be more readily driven into the hole and to resist its being withdrawn from the hole. Accordingly, the multi-cell opening 47 has been provided with substantially continuous side walls as shown in FIG. 14 free of obstructions within opening 47 whereby drainage fill material such as the pea gravel 56 or larger sized gravel can be readily poured into opening 47 after the wall has been constructed.

The lower ends of staples 49 have been tapered to a point to ease in their installation.

Figure 21:
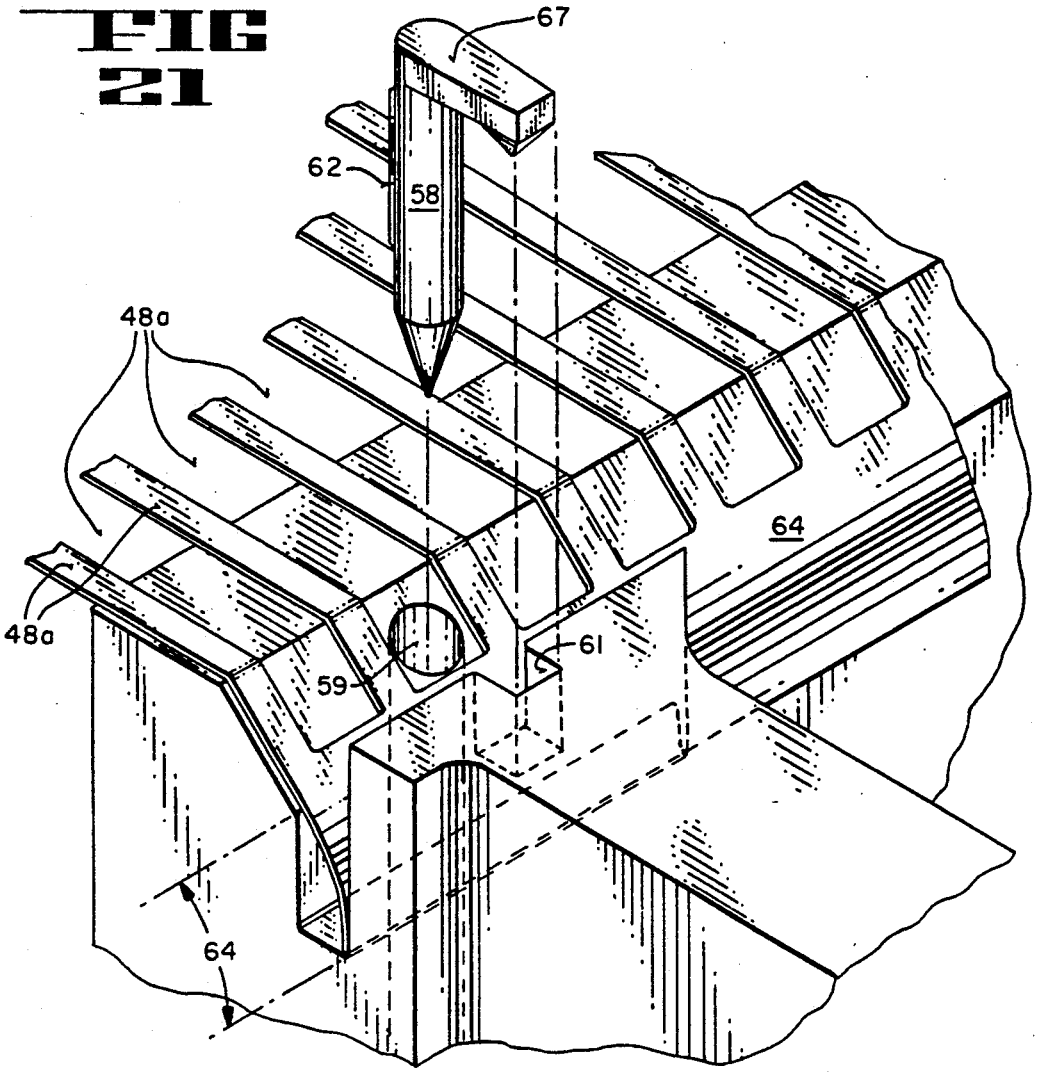
FIG. 21 shows in enlarged detail a perspective view of a "bridging" staple in position for anchoring the edge margin of a tie-back sheet.
Figure 22:
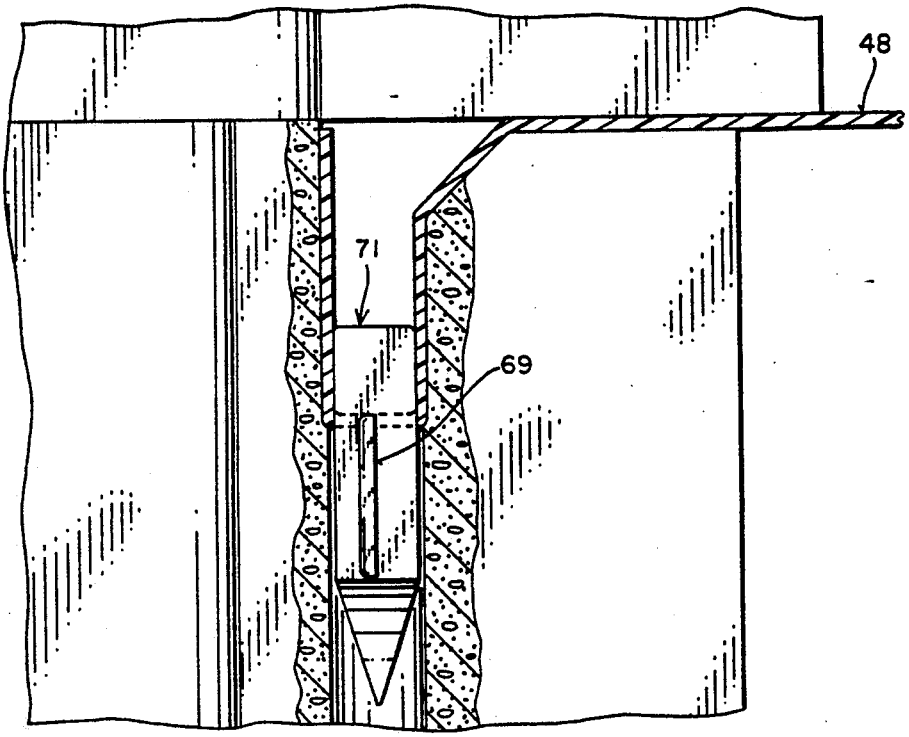
FIGS. 22 and 23, respectively, show side elevation views partially in section showing how the staple of FIG. 17 and the bridging staple of FIG. 20 serve to retain the edge margin of a tie-back sheet.

It has been observed that securing a tie-back sheet 48 by attachment to the strands 48*b* serves to concentrate the forces tugging on sheet 48 to act on a relatively narrow portion (strand 48*b*) of sheet 48. Accordingly, according to another embodiment in order to make a stronger attachment to sheet 48 as shown in FIG. 21, a bridging staple 57 includes an elongate element 58 formed and disposed to engage the side wall of one of the pair of openings 59, 61. Accordingly, an elongate wedging portion in the form of a rib 62 carried on the backside of element 58 serves to engage the inside wall of opening 59 as it is driven downwardly to same. Opening 59 is disposed to lie beneath one of the many elongate openings 48*a* of sheet 48 which is adjacent the end edge margin of the sheet 48. A transverse slot 63 on the forward side of the rear body 41 is deeper than slot 51, if desired for receiving the edge margin 64 of sheet 48.

Figure 20A:
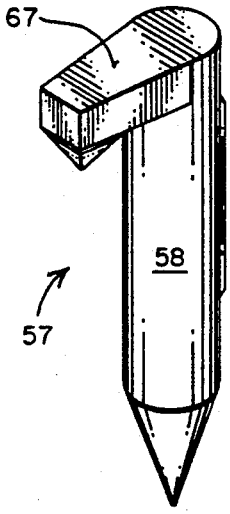
FIGS. 20A, 20B and 20C, respectively, show a perspective, side elevation and end elevation views of a "bridging" staple according to another embodiment.
Figure 20B:
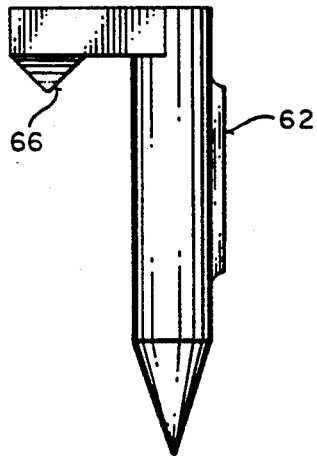
Figure 20C:
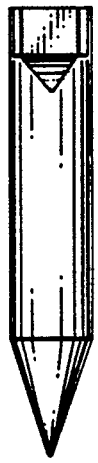

Accordingly, the staple 57 shown in FIG. 20 is of at least a semi-rigid material such as hard plastic and forms a unit including first and second downwardly depending elements, such as elongate element 58 and a downwardly depending detent 66. Staple 57 (as well as staple 49) includes a portion transverse to the elements thereof and integral with and extending between the upper ends of said elements. The transverse portion 67 can be referred to as a "bridging" portion and serves to capture a portion of sheet 48 therebeneath as shown best in FIG. 23.

The free end of bridging portion 67 lodges into a detent opening 61.

From the foregoing it will be readily evident that use of a staple 57 serves to engage a stronger portion of the sheet of tie-back material in order to prevent the tie-back sheet from becoming torn loose from the backside of the wall.

Figure 23:
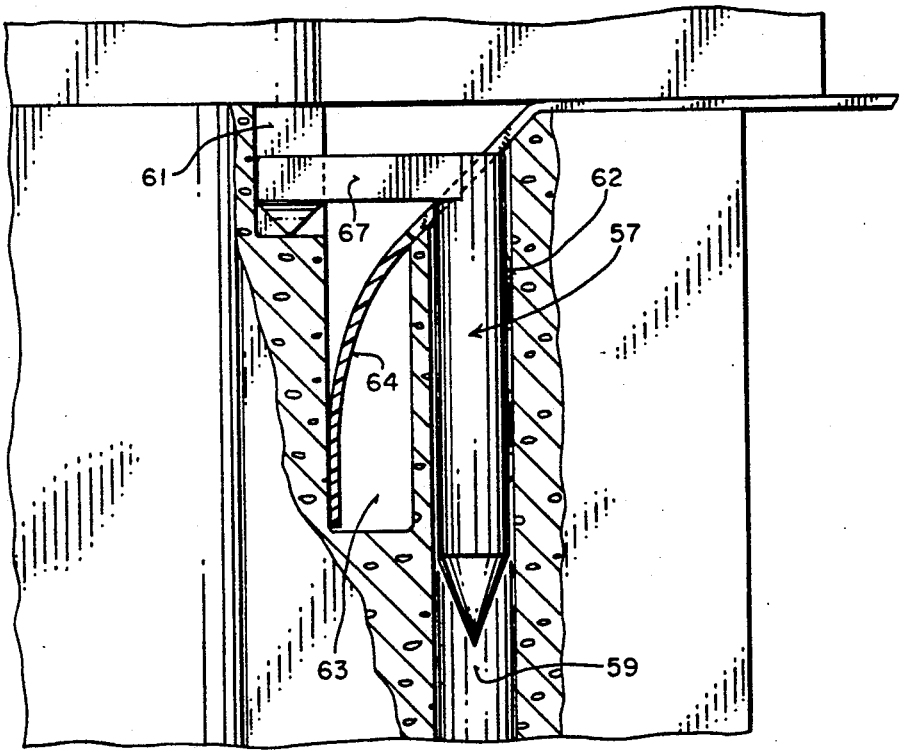

As shown in FIG. 23, as soon as a block is placed on top of a block containing a staple 57, the bridging staple 57 will be captured in place and unable to be removed without removing the overhead block. In addition, rib 62 serves to wedge element 58 into its associated opening 59 in order to provide a firm connection.

Figure 17:
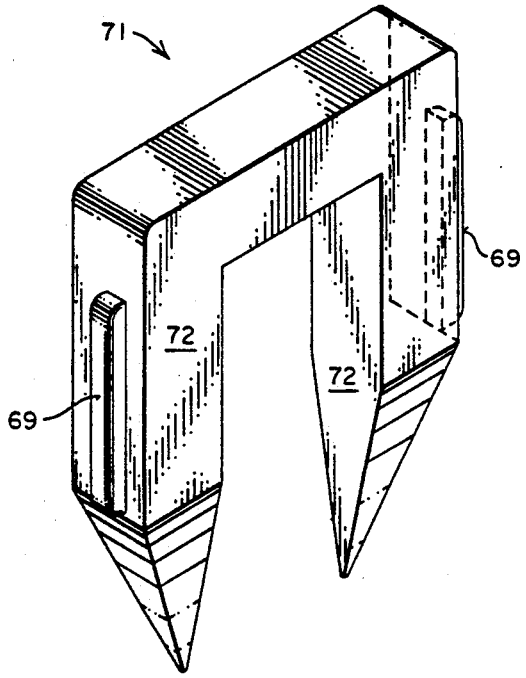
FIGS. 17 and 18 respectively show perspective and plan views of an improved staple.
Figure 18:
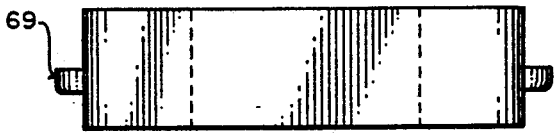
Figure 19:
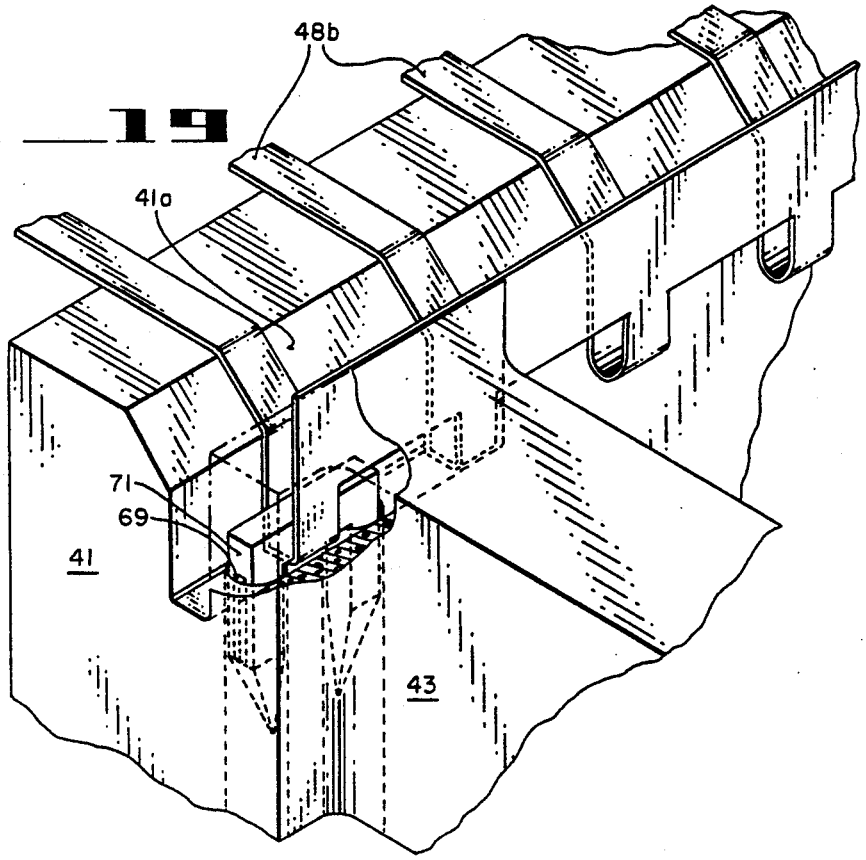
FIG. 19 shows in enlarged detail a perspective view with portions broken away for clarity to show the manner of anchoring part of a tie-back sheet to a block.

According to a preferred embodiment of staple 49 as shown in FIGS. 17 and 18, elongate ribs 69 have been formed on the sides of a staple 71 whereby as the elongate depending elements 72 are driven downwardly into a pair of openings 52 (FIG. 10) the ribs 69 will engage the side walls of openings 52 to retain staple 71 therein.

I claim:

1. A wall block assembly for use in making a retaining wall, comprising a first block, a second block substantially identical to said first block superimposed on said first block, each of said first and second blocks comprising leading and trailing bodies spaced apart, and a pair of side walls extending between quarter points of said leading body and a front face of said trailing body to form an unobstructed cell therebetween, and interlocking means carried by said leading body of said first block at said quarter points thereof to protrude therefrom for interengaging a leading body of said second block so as to positively locate said first and second blocks with respect to one another in a manner disposing with a side wall of said first block and a side wall of said second block in a substantially continuous uninterrupted vertical plane leaving said cells of said first and second blocks free of obstruction therein to enable drainage fill material to be readily poured into said cells from above free of any blockage thereto, means carried by said trailing body of said first block for securing the leading edge margin of a sheet of tie back material to form a tie back from a wall formed with said blocks, said cells of said first and second blocks remaining unobstructed from above after securing said sheet to the block.

2. A wall block assembly according to claim 1 in which said means carried by said trailing body comprises staple means and in which said sheet of tie back material includes many elongate openings therein disposed in parallel relation in a manner defining narrow strands of material therebetween and also defining leading edges integral with said strands extending transversely of said elongate openings, said means carried by said trailing body of said first block including at least one opening formed in said trailing body said opening having walls, and staple means having a pair of spaced elements formed and disposed to engage said walls and be retained therein, said staple means having a connecting portion integral with and extending between said spaced elements and serving to straddle a strand of said tie back material for retaining said tieback material to said trailing body.

3. A wall block assembly according to claim 1 in which said staple means includes a pair of said elements of substantially equal length.

4. A wall block assembly according to claim 2 in which said staple means includes an elongate element formed and disposed to engage said walls of said at least one opening, said trailing body having a forward side, a transverse slot on said forward side of said trailing body for receiving said leading edge margin.

5. A wall block assembly according to claim 1 in which said means carried by said trailing body comprises staple means and in which said sheet of tie back material includes many elongate openings therein disposed in parallel relation in a manner defining narrow strands of material therebetween and also defining leading edges integral with said strands extending transversely of said elongate openings, said means carried by said trailing body, of said first block including at least one opening formed in said trailing body said opening having walls, and staple means having spaced elements formed and disposed to engage said walls of said at least one opening of said trailing body and to be retained therein, said staple means having a connecting portion between said spaced elements and formed and disposed to engage a margin of at least one elongate opening of said tie back material.

6. In combination, a wall block for retaining walls comprising a trailing member formed with at least one substantially vertical hole having hole walls, a sheet of tie back material formed with plural elongate openings defining narrow strands of material there between and leading edges integral with said strands extending transversely of said elongate openings, and a staple formed of at least semi-rigid material comprising first and second downward depending elements at least one said element being shaped to fit through one of said elongate openings and then within said at least one said hole and adapted to engage at least one said hole wall and to be retained therein, said staple further comprising a transverse portion interconnecting said depending elements and adapted to capture a portion of said tie back material.

7. A staple according to claim 6 in which said staple has two depending elements are of substantially equal length.

8. A staple according to claim 6 in which one of said depending elements has a substantial length while the other said depending element forms a detent of limited length.

* * * * *